US006327873B1

(12) United States Patent
Dray et al.

(10) Patent No.: US 6,327,873 B1
(45) Date of Patent: Dec. 11, 2001

(54) CRYOGENIC RECTIFICATION SYSTEM FOR PRODUCING ULTRA HIGH PURITY OXYGEN

(75) Inventors: James Robert Dray, Buffalo; Scot Eric Jaynes, Lockport, both of NY (US)

(73) Assignee: Praxair Technology Inc., Danbury, CT (US)

( * ) Notice: Subject to any disclaimer, the term of this patent is extended or adjusted under 35 U.S.C. 154(b) by 0 days.

(21) Appl. No.: 09/593,746

(22) Filed: Jun. 14, 2000

(51) Int. Cl.[7] ..... F25J 1/00
(52) U.S. Cl. ..... 62/648; 62/925
(58) Field of Search ..... 62/648, 925

(56) References Cited

U.S. PATENT DOCUMENTS

| | | | | |
|---|---|---|---|---|
| 4,401,448 | * | 8/1983 | La Clair | 62/925 |
| 4,560,397 | | 12/1985 | Cheung | 62/28 |
| 4,755,202 | | 7/1988 | Cheung | 62/17 |
| 4,780,118 | | 10/1988 | Cheung | 62/11 |
| 5,049,173 | | 9/1991 | Cormier, Sr. et al. | 62/24 |
| 5,069,698 | * | 12/1991 | Cheung et al. | 62/925 |
| 5,195,324 | | 3/1993 | Cheung | 62/24 |
| 5,528,906 | | 6/1996 | Naumovitz et al. | 62/652 |
| 5,582,032 | | 12/1996 | Shelton et al. | 62/643 |
| 5,918,482 | | 7/1999 | Potempa | 62/646 |

* cited by examiner

*Primary Examiner*—Ronald Capossela
(74) *Attorney, Agent, or Firm*—Stanley Ktorides

(57) ABSTRACT

A cryogenic rectification system comprising an upstream krypton/xenon knockout column and a downstream oxygen upgrader column wherein the knockout column processes a crude feed for removal of heavy components including hydrocarbons and the upgrader column produces ultra high purity oxygen.

10 Claims, 2 Drawing Sheets

CRYOGENIC RECTIFICATION SYSTEM FOR PRODUCING ULTRA HIGH PURITY OXYGEN

TECHNICAL FIELD

This invention relates generally to cryogenic rectification and, more particularly, to the use of cryogenic rectification to produce ultra high purity oxygen.

BACKGROUND ART

Ultra high purity oxygen is required in manufacturing processes that are very sensitive to contaminants, such as in the production of semiconductors and other electronic components. As the demand for ultra high purity oxygen increases, there is a need for a system which can efficiently produce ultra high purity oxygen.

Accordingly, it is an object of this invention to provide an improved system for producing ultra high purity oxygen.

SUMMARY OF THE INVENTION

The above and other objects, which will become apparent to those skilled in the art upon a reading of this disclosure, are attained by the present invention, one aspect of which is:

A method for producing ultra high purity oxygen by cryogenic rectification comprising:

(A) providing a feed comprising oxygen, argon, krypton and xenon, and passing the feed into the upper portion of a first column;

(B) separating the feed by cryogenic rectification within the first column into a top fluid comprising oxygen and argon, and into a bottom fluid comprising krypton and xenon;

(C) passing top fluid from the upper portion of the first column into the upper portion of a second column, and separating the top fluid by cryogenic rectification within the second column into argon-enriched fluid and ultra high purity oxygen; and (D) withdrawing ultra high purity oxygen from the lower portion of the second column and recovering the withdrawn ultra high purity oxygen as product.

Another aspect of the invention is:

Apparatus for producing ultra high purity oxygen comprising:

(A) a first column having a top condenser and a bottom reboiler, and means for passing a feed comprising oxygen, argon, krypton and xenon into the upper portion of the first column;

(B) a second column having a top condenser and a bottom reboiler, and means for passing fluid from the upper portion of the first column into the upper portion of the second column;

(C) means for passing fluid from the bottom reboiler of the first column to the top condenser of the first column, and means for passing fluid from the bottom reboiler of the second column to the top condenser of the second column; and (D) means for recovering ultra high purity oxygen from the lower portion of the second column.

As used herein the term "ultra high purity oxygen" means a fluid having an oxygen concentration of at least 99.99 mole percent.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "upper portion" and "lower portion" mean those sections of a column respectively above and below the mid point of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "top" when referring to a column means that section of the column above the column mass transfer internals, i.e. trays or packing.

As used herein, the term "bottom" when referring to a column means that section of the column below the column mass transfer internals, i.e. trays or packing.

As used herein, the term "bottom reboiler" means a heat exchanger for generating column upflow vapor from column liquid.

As used herein, the term "top condenser" means a heat exchanger for generating column downflow liquid from column vapor.

Figure 1:
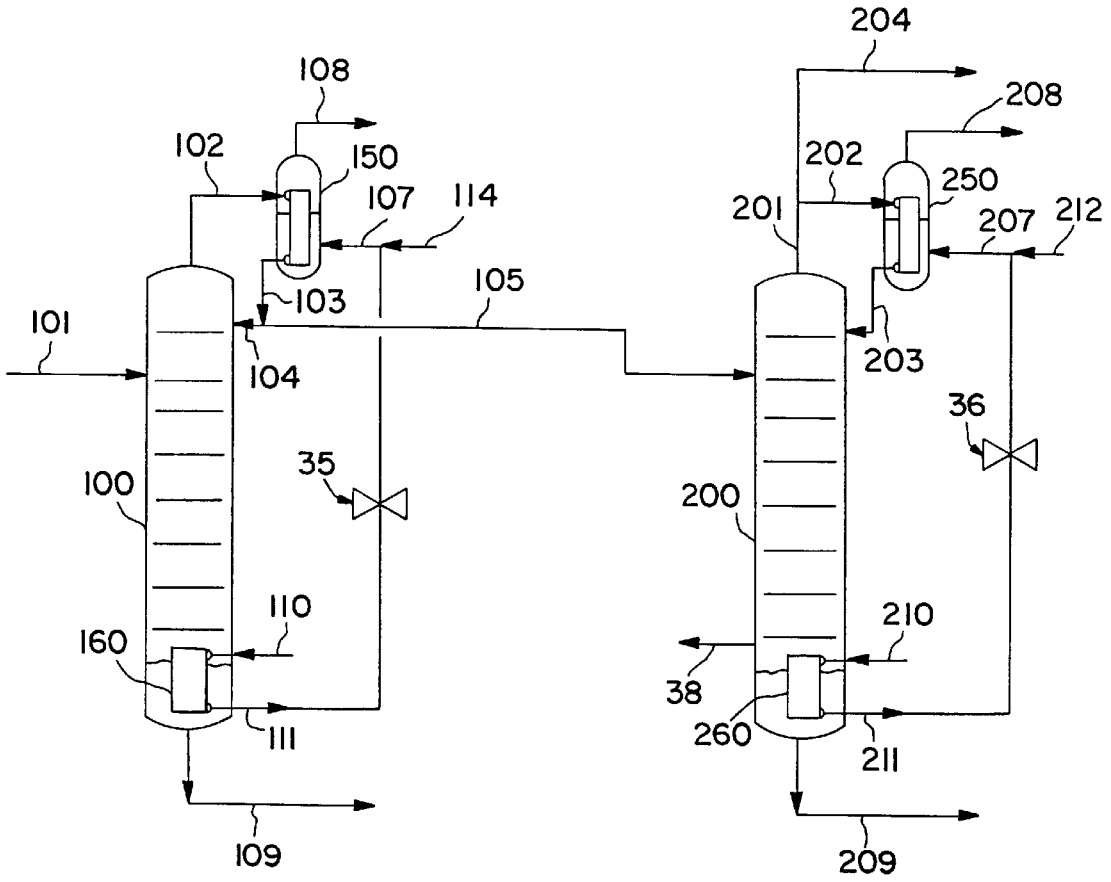
FIG. 1 is a schematic representation of one preferred embodiment of the ultra high purity oxygen production system of this invention.

The numerals in the Drawings are the same for the common elements.

DETAILED DESCRIPTION

The invention will be described in detail with reference to the Drawings.

Referring now to FIG. 1, feed stream 101 is passed into the upper portion of first column 100, which is operating at a pressure generally within the range of from 15 to 50 pounds per square inch absolute (psia). Stream 101 may be liquid, gaseous or mixed phase. Typically stream 101 is taken from a cryogenic air separation plant such as a single column nitrogen plant, a double column plant producing oxygen or both nitrogen and oxygen, or a triple column plant producing argon in addition to oxygen and nitrogen.

Feed 101 comprises oxygen, argon, krypton and xenon. Generally feed 101 has an oxygen concentration within the range of from 98 to 99.9 mole percent. Because the product of this invention is ultra high purity oxygen, it is imperative that the presence of flammables such as hydrocarbons be minimized in the process. It is preferred in the practice of this invention that feed 101 undergo hydrocarbon removal prior to passage into first column 100. In one preferred hydrocarbon removal procedure, the hydrocarbons are removed by heating the feed to about 1000° F. and passing the heated feed over a rare earth catalyst such as platinum. The hydrocarbons will combine with oxygen in the feed and be converted to carbon dioxide and water. The resulting feed which is now substantially free of hydrocarbons is cooled and passed through a molecular sieve dryer to remove the carbon dioxide and water and then further cooled, preferably to just above its saturation point, prior to passage into first column 100.

Feed 101 preferably is passed into first column 100 at a level from 20 to 30 equilibrium stages below the top of column 100. Within first column 100, feed 101 is separated by cryogenic rectification into a top fluid comprising oxygen and argon and into a bottom fluid which contains most of the krypton and xenon which was in feed 101.

First column 100 has top condenser 150 and bottom reboiler 160. Bottom reboiler 160 is driven by vapor 110, such as oxygen, which is condensed in reboiler 160 by indirect heat exchange with the bottom fluid to provide vapor upflow for the column. Preferably vapor 110 is from the cryogenic air separation system from which feed stream 101 is taken. The resulting condensed reboiler driving fluid 111 is throttled through valve 35 and then passed into top condenser 150 as stream 107. If necessary, additional liquid 114 may be passed into top condenser 150 to ensure that sufficient refrigeration is supplied to top condenser 150 to adequately reflux first column 100. Bottom liquid, having a higher concentration of krypton and/or xenon as a result of the reboiling, is withdrawn from the system in stream 109. Typically the bottom fluid in stream 109 will have a krypton and xenon concentration of at least 90 mole percent. Stream 109 may contain a small fraction of oxygen, generally from 1 to 10 mole percent, as well as trace amounts of other components having boiling points higher than oxygen.

Top fluid is withdrawn from the upper portion of the first column and passed into the upper portion of a second column. In the embodiment of the invention illustrated in FIG. 1, top fluid comprising oxygen and argon is withdrawn from the top of first column 100 in vapor stream 102 which is passed into top condenser 150. Within top condenser 150 top fluid 102 is condensed by indirect heat exchange with driving fluid 107 which is at least partially vaporized and withdrawn from the system in stream 108. Resulting condensed top fluid 103 from top condenser 150 is passed as reflux stream 104 back into first column 100, and as stream 105 into the upper portion of second column 200 as was previously described. Preferably feed stream 105 containing oxygen and argon is passed into second column 200 at a level from 3 to 40 equilibrium stages below the top of second column 200. Top condenser 150 is operated in such a manner to ensure that any hydrocarbons that may be in feed stream 101 are washed down the column by the downflowing reflux and removed from the system in stream 109, thereby enabling the feed to the second column to be essentially free of any hydrocarbons.

Second or upgrader column 200 is operating at a pressure generally within the range of from 15 to 50 psia. Within second column 200 the top fluid passed into this column from first column 100 is separated by cryogenic rectification into argon-enriched fluid and ultra high purity oxygen.

Second column 200 has a top condenser 250 and a bottom reboiler 260. Bottom reboiler 260 is driven by vapor 210 such as nitrogen, which is condensed in reboiler 260 by indirect heat exchange with ultra high purity oxygen liquid at the bottom of second column 200, serving to boil a portion of this liquid to provide vapor upflow for the column and in the process increasing the oxygen concentration of the ultra high purity oxygen liquid. Preferably vapor 210 is taken from the air separation system from which feed 101 is taken. The resulting condensed reboiler driving fluid 211 is throttled through valve 36 and then passed into top condenser 250 as stream 207. If necessary, additional liquid 212 may be passed into top condenser 250 to ensure that sufficient refrigeration is supplied to top condenser 250 to reflux second column 200. Ultra high purity oxygen bottom liquid, having a higher concentration of oxygen as a result of the reboiling, is withdrawn from the lower portion of second column 200 in stream 209 and recovered as product ultra high purity oxygen. If desired, in addition to or in place of liquid stream 209, ultra high purity oxygen may be recovered from second column 200 from above bottom reboiler 260 as shown by stream 38.

Argon-enriched fluid is withdrawn from the upper portion of second column 200 in vapor stream 201 and a portion 204 is removed from the system as an overhead waste stream. Another portion 202 is passed into top condenser 250 wherein it is condensed by indirect heat exchange with driving fluid 207 which is at least partially vaporized and removed from the system in stream 208. Resulting condensed argon-enriched fluid 203 from top condenser 25 is passed back into the upper portion of second column 200 as reflux.

Figure 2:
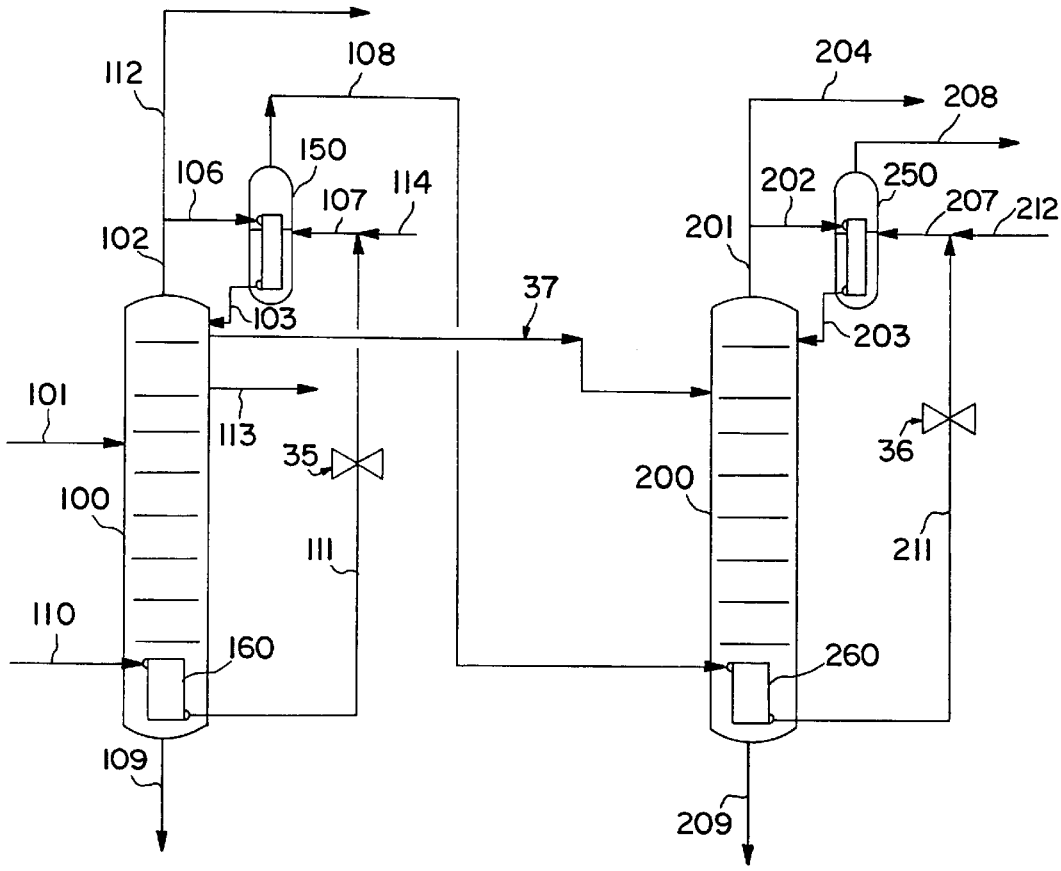
FIG. 2 is a schematic representation of another preferred embodiment of the ultra high purity oxygen production system of this invention.

FIG. 2 illustrates another embodiment of the invention. The elements of the embodiment illustrated in FIG. 2 which are common with those elements of the embodiment illustrated in FIG. 1 will not be described again in detail. Referring now to FIG. 2, top fluid stream 102 is divided into portion 112, which is removed from the system, and into portion 106 which is passed into top condenser 150 for condensation to produce reflux liquid 103 which is passed back into first column 100 in its entirety. In the embodiment of the invention illustrated in FIG. 2, the top fluid for passage into the upper portion of the second column is taken directly from the upper portion of first column 100 as stream 37 without first going through the top condenser as in the embodiment illustrated in FIG. 1. An oxygen stream 113, having an oxygen concentration generally within the range of from 99 to 99.99 mole percent, is withdrawn from the upper portion of first column 100, but from a level at least one equilibrium stage below the withdrawal level of the top fluid, e.g., stream 37. Oxygen stream 113 may be recovered as product or may be passed on to another column for further processing.

In the embodiment of the invention illustrated in FIG. 2, vaporized first column top condenser driving fluid 108 is not directly removed from the system but instead is passed into second column bottom reboiler 260 wherein it is condensed by indirect heat exchange with ultra high purity oxygen liquid and then passed on to top condenser 250 as was previously described.

Although the invention has been described in detail with reference to certain preferred embodiments, those skilled in the art will recognize that there are other embodiments of the invention within the spirit and the scope of the claims.

What is claimed is:

1. A method for producing ultra high purity oxygen by cryogenic rectification comprising:

(A) providing a feed comprising oxygen, argon, krypton and xenon, and passing the feed into the upper portion of a first column;

(B) separating the feed by cryogenic rectification within the first column into a top fluid comprising oxygen and argon, and into a bottom fluid comprising krypton and xenon;

(C) passing top fluid from the upper portion of the first column into the upper portion of a second column, and separating the top fluid by cryogenic rectification within the second column into argon-enriched fluid and ultra high purity oxygen; and (D) withdrawing ultra high purity oxygen from the lower portion of the second column and recovering the withdrawn ultra high purity oxygen as product.

2. The method of claim 1 wherein at least some of the ultra high purity oxygen product is recovered as liquid.

3. The method of claim 1 wherein the bottom fluid has a krypton and xenon concentration of at least 90 mole percent.

4. The method of claim 1 wherein the feed has an oxygen concentration within the range of from 98 to 99.9 mole percent.

5. The method of claim 1 wherein the feed undergoes a hydrocarbon removal procedure prior to being passed into the first column.

6. The method of claim 5 wherein the hydrocarbon removal procedure comprises heating the feed, passing the heated feed over a rare earth catalyst, cooling the feed, and passing the cooled feed through a molecular sieve dryer.

7. Apparatus for producing ultra high purity oxygen comprising:

(A) a first column having a top condenser and a bottom reboiler, and means for passing a feed comprising oxygen, argon, krypton and xenon into the upper portion of the first column;

(B) a second column having a top condenser and a bottom reboiler, and means for passing fluid from the upper portion of the first column into the upper portion of the second column;

(C) means for passing fluid from the bottom reboiler of the first column to the top condenser of the first column, and means for passing fluid from the bottom reboiler of the second column to the top condenser of the second column; and (D) means for recovering ultra high purity oxygen from the lower portion of the second column.

8. The apparatus of claim 7 wherein the means for passing fluid from the upper portion of the first column into the upper portion of the second column includes the top condenser of the first column.

9. The apparatus of claim 7 further comprising means for passing fluid from the top condenser of the first column to the bottom reboiler of the second column.

10. The apparatus of claim 7 further comprising means for recovering fluid from the bottom of the first column.

* * * * *